US006513954B2

(12) United States Patent
Ebersole

(10) Patent No.: US 6,513,954 B2
(45) Date of Patent: Feb. 4, 2003

(54) RAINBOW PROJECTION LIGHT

(76) Inventor: Glenn R Ebersole, 1085 Valley Green Rd., Etters, PA (US) 17319

( * ) Notice: Subject to any disclaimer, the term of this patent is extended or adjusted under 35 U.S.C. 154(b) by 48 days.

(21) Appl. No.: 09/796,308

(22) Filed: Feb. 28, 2001

(65) Prior Publication Data

US 2002/0159260 A1 Oct. 31, 2002

(51) Int. Cl.[7] ..... F21V 5/02; F21V 29/00

(52) U.S. Cl. ..... 362/339; 362/806; 362/373; 362/294; 362/19

(58) Field of Search ..... 362/806, 811, 362/1, 2, 19, 339, 294, 373

(56) References Cited

U.S. PATENT DOCUMENTS 4,214,297 A * 7/1980 Kunh et al. ..... 362/327
4,557,055 A * 12/1985 Arai ..... 353/81
4,681,402 A * 7/1987 Tiffany ..... 350/286
4,849,866 A * 7/1989 Mori ..... 362/327
4,955,975 A * 9/1990 Mori ..... 350/96.19
5,146,364 A * 9/1992 Oku ..... 359/615
5,247,491 A * 9/1993 Kwiatkowski ..... 368/79

* cited by examiner

*Primary Examiner*—Laura K. Tso
(74) *Attorney, Agent, or Firm*—Michael I. Kroll

(57) ABSTRACT

The present invention 10 discloses an internal prism 20 for displaying a rainbow onto a surface by separating the spectrum of white light produced by a halogen lamp 44. The lighting device has a cylindrical housing 16 having external means for adjusting the intensity of the display in the form of a three way dimmer switch 18. The prism 20 is selectively held in place by threaded stud members 22 with finger nuts 24 positioned at each end thereof, whereby the prism can be selectively moved or rotated from one position to another. Also shown is a planar opaque element or light filter 26 having a slot 28 therein whereby the light is projected through the prism. Also shown are a lamp cover 30, vertical slots 32 for receiving and adjustment of the threaded studs 22 along with a power source 34 and air intake vents 36 on the bottom of the housing 16. Alternative embodiments disclose a rotatable base 66 and a rectangular housing.

7 Claims, 10 Drawing Sheets

RAINBOW PROJECTION LIGHT

BACKGROUND OF THE INVENTION

1. Field of the Invention

The present invention relates generally to lighting devices and, more specifically, to prism lighting devices. The present invention is a lighting device having a housing with means for projecting a spectrum of visible light upon an exterior surface. The prism lighting device has electrical means for energizing a light bulb, preferably a halogen lamp, that has a reflector element for projecting the light upon a planar element having a slit wherethrough the light beam passes. Positioned over the slit is a prism being of a size that is slightly larger than the slit. Upon entering the prism the white light is slit and projected out into various wavelengths representative of a rainbow.

The prism is fixed to the housing at each distal end by threaded members whereby the distance between the prism and the light egress slit can be selectively adjusted. The housing has a covering extending from the housing in a spherical fashion having its apex and termination over the prism.

Within the housing there is electrical means in the form of a transformer having external power for energizing the lamp. There is also a fan positioned at the base of the lighting device which draws air through vents in the base of the housing to dissipate accumulated heat.

A power switch is located on the exterior surface of the housing for powering on the light as well as controlling the light bulb lumens.

The lighting device in an alternative design may also have a motor within the base for rotating the housing throughout 360 degrees.

The housing can take the form of a cylinder, rectangle or other suitable container.

2. Description of the Prior Art

There are other prism lighting device designed for spectral projection. Typical of these is U.S. Pat. No. 909,507 issued to Zubli on Jan. 12, 1909.

Another patent was issued to Collins on Apr. 11, 1922 as U.S. Pat. No. 1,412,675. Yet another U.S. Pat. No. 2,341,223 was issued to Lillie on Oct. 11, 1940 and still yet another was issued on Jul. 22, 1980 to Kuhn et al. as U.S. Pat. No. 4,214,297.

Another patent was issued to Arai on Dec. 10, 1985 as U.S. Pat. No. 4,557,055. Yet another U.S. Pat. No. 4,681,402 was issued to Tiffany on Jul. 21, 1987. Another was issued to Mori on Jul. 18, 1989 as U.S. Pat. No. 4,849,866 and still yet another was issued on Sep. 11, 1990 to Mori as U.S. Pat. No. 4,955,975.

Another patent was issued to Oku on Sep. 8, 1992 as U.S. Pat. No. 5,146,364 and another was issued to Kwaitkowski on Sep. 21, 1993 as U.S. Pat. 5,247,491.

U.S. Pat. No. 909,507

Inventor: Justus C. Zubli

Issued: Jan. 12, 1909

An illuminating device, comprising an electric lamp, and a prism rotatably mounted in front of the bulb of the lamp, and means in connection with the mounting for permitting said prism to swing with respect to the lamp.

U.S. Pat. No. 1,412,675

Inventor: Frank D. Collins

Issued: Apr. 11, 1922

An illuminating apparatus, the combination of a lens, a prism located in front of the lens, and a rotary lamp located in rear of the lens and in line with the lens and prism, and having a filament stretch arranged to intersect a line extending through the lens and prism.

U.S. Pat. Number 2,341,223

Inventor: William Lillie

Issued: U.S. Pat. No. 2,341,223

Apparatus of the character described, comprising a casing consisting of complementary half portions, a cover mounter over one end of the casing, being fitted over said half portions to aid in holding them closed, a sleeve fitted upon said half portions at the other end of the casing also aiding in holding said half portions closed, cheek members projecting forwardly of the sleeve and providing a bearing crosswise of the axis of the casing, a glass prism axially supported by said cheek members across the adjacent end of the casing, and means contained by the casing directing a light beam onto the prism for projection through the prism and away from the casing as spectrum rays.

U.S. Pat. No. 4,214,297

Inventor: Gebhard Kuhn et al.

Issued: Jul. 22, 1980

The invention is in concern of an arrangement for producing artificial rainbows, particularly for use in planetaria, in which a bundle of light emitted from a light source and directed through an aperture upon a prism is dispersed by the latter and reflected at a cylindrical reflector. Due to the reflection at the cylindrical reflector the projected light bundle is of a rainbow shape, the radius thereof depends on the position of the cylindrical reflector relative to the prism.

U.S. Pat. No. 4,557,055

Inventor: Akira Arai

Issued: Dec. 10, 1985

The present invention relates to a rainbow image projector adapted to project a vivid rainbow image from a relatively small light source onto walls of a stage, a store, places for various parties, and like. Specifically, light rays emitted from the linear incandescent light source are converted by a cylindrical condenser lens into parallel light rays which are, in turn, obliquely incident on a triangular prism over whole area of its first refraction plane. Thus, it is possible to project a vivid rainbow image of a large curvature radius from the small light source of small power consumption and heat generation. A housing containing therein said linear light source, cylindrical condenser lens and prism and provided with a projection window is inclination-adjustably mounted an inclination adjustment screw on a support leg so that a direction in which the rainbow image is projected may be variable. Said housing further comprises a blower for cooling contained therein and has a rear cover for exchange of the light source so that a useful life of the light source may be prolonged and maintenance and/or checking thereof may be easily done.

U.S. Pat. No. 4,681,402

Inventor: Carlton R. Tiffany

Issued: Jul. 21, 1987

A method and means for projecting a secondary rainbow of natural configuration comprising an arcuate prism of greater than about 180 degrees of arc and optionally an arcuate prism orienting means. The primary and secondary refractive surfaces of arcuate prism are oriented such that they meet along the edge of said arcuate prism closest to that point at the center of said arc. The angle formed by the primary and secondary refractive surfaces of said arcuate prism is from about 25 degrees to about 75 degrees, the "active range." When the prism is of polymethyl methacrylate (such as Lucite) the refractive surfaces subtend an angle of greater than about 35 degree and less than about 65 degrees, the "particular active range." Prisms within the active range provide for the projection of a secondary rainbow of natural configuration when a light course of generally parallel rays of light is oriented at a position from less than about 30 degrees from perpendicular relative to a plane through the interior edge of the prism. Prism materials of high indices of refraction will project secondary rainbows from a point where incident light forms an angle of less than about 30 degrees. This constitutes the maximum effective angular range.

U.S. Pat. No. 4,849,866

Inventor: Kei Mori

Issued: Jul. 18, 1989

A rainbow-creating device comprises optical conductors through which light rays consisting of visible light ray components are transmitted. A lens is placed opposite the respective light-emitting ends of the optical conductors for converting the light rays emitted from them to parallel light rays. Prisms are placed for receiving the parallel light rays from the lens and for effecting the spectroscopic separation of the parallel light rays.

U.S. Pat. No. 4,955,975

Inventor: Kei Mori

Issued: Sep. 11, 1990

A rainbow forming device includes a light guide for transmitting visible light therethrough and a prism having a cross-section of a substantially equilateral triangle for splitting the light into a series of colors of the spectrum to form a rainbow. A light-emitting end of the light guide is set with its axis perpendicular to the prism's first edge. The visible light emitted from the light guide's end passes through the prism along the path from prism's first vertex including the prism's first edge to said prism's second vertex and the light split into colors of the spectrum are emitted from the prism's third vertex and forms a rainbow.

U.S. Pat. No. 5,146,364

Inventor: Kimio Oku

Issued: Sep. 8, 1992

This invention is directed to an optical instrument including a prism and a convex reflective surface for producing artificial rainbows which is used for a display in halls of entertainment as well as in shops and for interior decoration. Comparatively small optical instruments can also be used as a toy.

U.S. Pat. No. 5,247,491

Inventor: Zdzislaw Kwiatkowski

Issued: Sep. 21, 1993

A device for projecting a rainbow-like spectral display including a housing provided with a projecting arrangement for projecting the rainbow-like spectral display onto a viewable surface. The projecting arrangement includes segments, each segment including a light emitting source for producing light rays, and a diffraction member such as a prism for effecting a spectral dispersion of the light rays for projecting same to produce the rainbow-like spectral display. Preferably, each segment also includes a convergent or convex lens disposed between the light emitting source and the diffraction member, and a reflector covering a rear portion of each light emitting source. The housing could be portable, battery operated, and in the form of a casing provided with a hinged cover. The segments have a particular design so that in one embodiment, the rainbow-like spectral display is in the form of a religious symbol, and in another embodiment, the rainbow-like spectral display is in the form of a rainbow-like spectral digital time display. In a further embodiment, the device is a clock or watch with the projecting arrangement including numerous units angularly disposed side-by-side in a circle, with each unit including three segments disposed end to end, so that energizing particular ones of the light emitting sources of selected units provides a second hand, a minute hand and an hour hand for a rainbow-like spectral time display.

While these spectral lighting devices may be suitable for the purposes for which they were designed, they would not be as suitable for the purposes of the present invention, as hereinafter described.

SUMMARY OF THE PRESENT INVENTION

The present invention discloses a lighting device which uses a prism to project a spectrum of light onto a surface and having a housing having external means for adjusting the intensity of the display in the form of a three way dimmer switch. The prism is selectively held in place by threaded members positioned at each distal end whereby the prism can be selectively moved from one position to another. Also shown is a planar opaque element having a slot whereby the light is projected through the prism. The present invention operates by having an internal prism produce a rainbow by separating the spectrum of white light produced by a halogen lamp. The prism is selectively held in place by threaded stud members with finger nuts positioned at each end thereof, whereby the prism can be selectively moved or rotated from one position to another. Also shown are a lamp cover, vertical slots for receiving and adjustment of the prism using threaded studs along with a power source and air intake vents on the bottom of the housing. Alternative embodiments disclose a rotatable base and a rectangular housing.

A primary object of the present invention is to provide a lighting device that is capable of projecting a rainbow upon an exterior surface.

Another object of the present invention is to provide a lighting device having an external power source for energizing a light bulb that will emit light that can be directed through a prism.

Yet another object of the present invention is to provide a lighting device having a light beam source and a planar surface with a slit therein for directing the light beam onto a prism.

Still yet another object of the present invention is to provide a lighting device having a prism with retaining means whereby the distance between the light aperture slit and the prism can be selectively adjusted.

Another object of the present invention is to provide a lighting device having a partial covering being opaque for directing light in one direction.

Yet another object of the present invention is to provide a lighting device having a housing with apertures therein and a fan for displacing heat from within the housing to the exterior.

Still yet another object of the present invention is to provide a lighting device having switch means for adjusting the luminous intensity of the display.

Another object of the present invention is to provide a lighting device that can incorporate a motor whereby the device can be rotated through 360 degrees.

Yet another object of the present invention is to provide a lighting device that is economical to manufacture and can selectively project a rainbow upon a selected surface.

Additional objects of the present invention will appear as the description proceeds.

The present invention overcomes the shortcomings of the prior art by providing a lighting device having a housing with means for projecting a spectrum of visible light upon an exterior surface in the form of a rainbow. The prism lighting device having electrical means for energizing a light bulb, preferably a halogen lamp, that has a reflector element for projecting the light upon a planar element having a slit wherethrough the light beam passes into a prism wherein the light is divided into various wavelengths.

The prism further has means for adjusting the distance between the prism and the light source.

The lighting device can also have a motor within the base for rotating the housing throughout 360 degrees.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
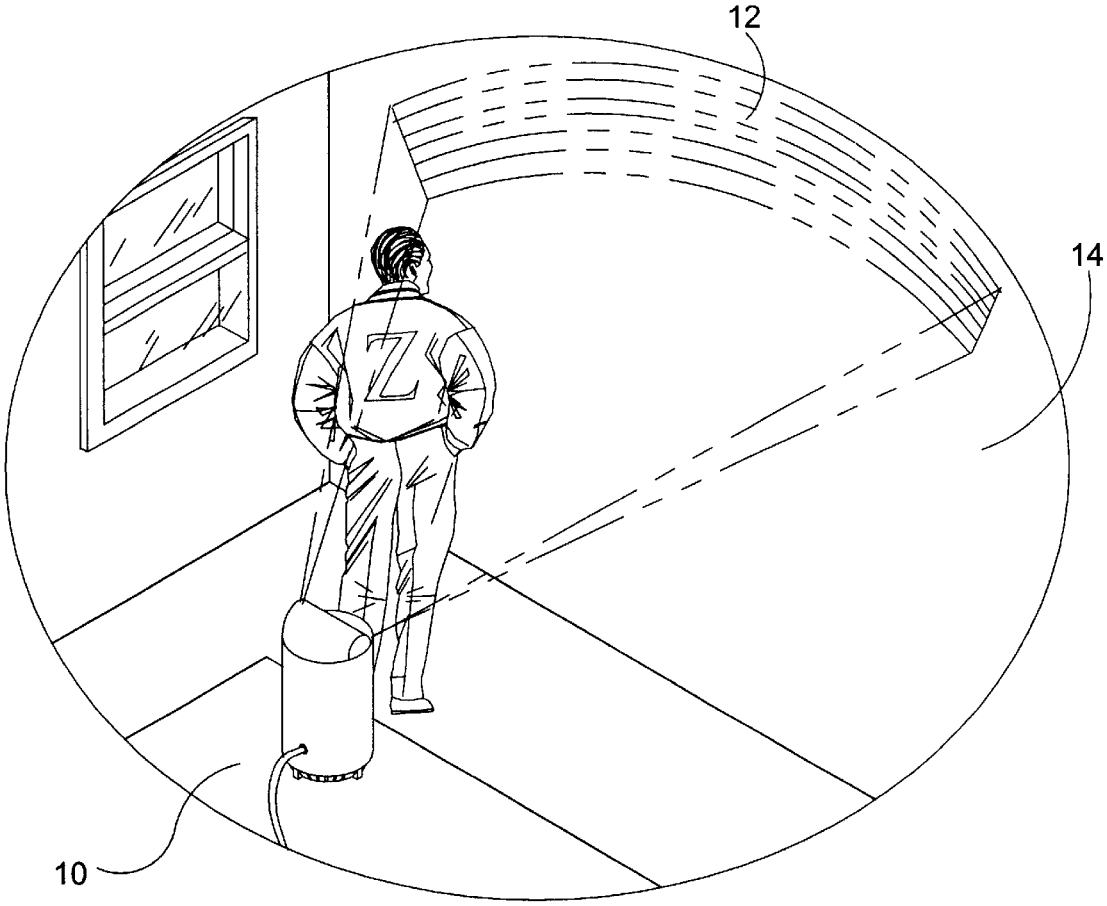
FIG. 1 is a perspective view of the present invention in use.

With regard to reference numerals used, the following numbering is used throughout the drawings.

10 present invention
12 rainbow
14 wall
16 housing
18 dimmer switch
20 prism
22 studs
24 nuts
26 light filter
28 light slot
30 cover
32 vertical slots
34 power source
36 air vent
38 transformer
40 cooling fan
42 fan housing
44 lamp
46 support member
48 lamp fixture
50 unfiltered light
52 filtered light
54 red
56 orange
58 yellow
60 green
62 blue
64 violet
66 motorized base
68 switch
70 motor
72 copper rings
74 brushes

DESCRIPTION OF THE PREFERRED EMBODIMENT

The following discussion describes in detail one embodiment of the invention and several variations of that embodiment. This discussion should not be construed, however, as limiting the invention to those particular embodiments.

Practitioners skilled in the art will recognize numerous other embodiments as well. For a definition of the complete scope of the invention, the reader is directed to appended claims.

Turning to FIG. 1, shown therein is a perspective view of the present invention 10 in use showing the lighting device projecting a rainbow 12 onto an interior wall 14 of a room.

Figure 2:
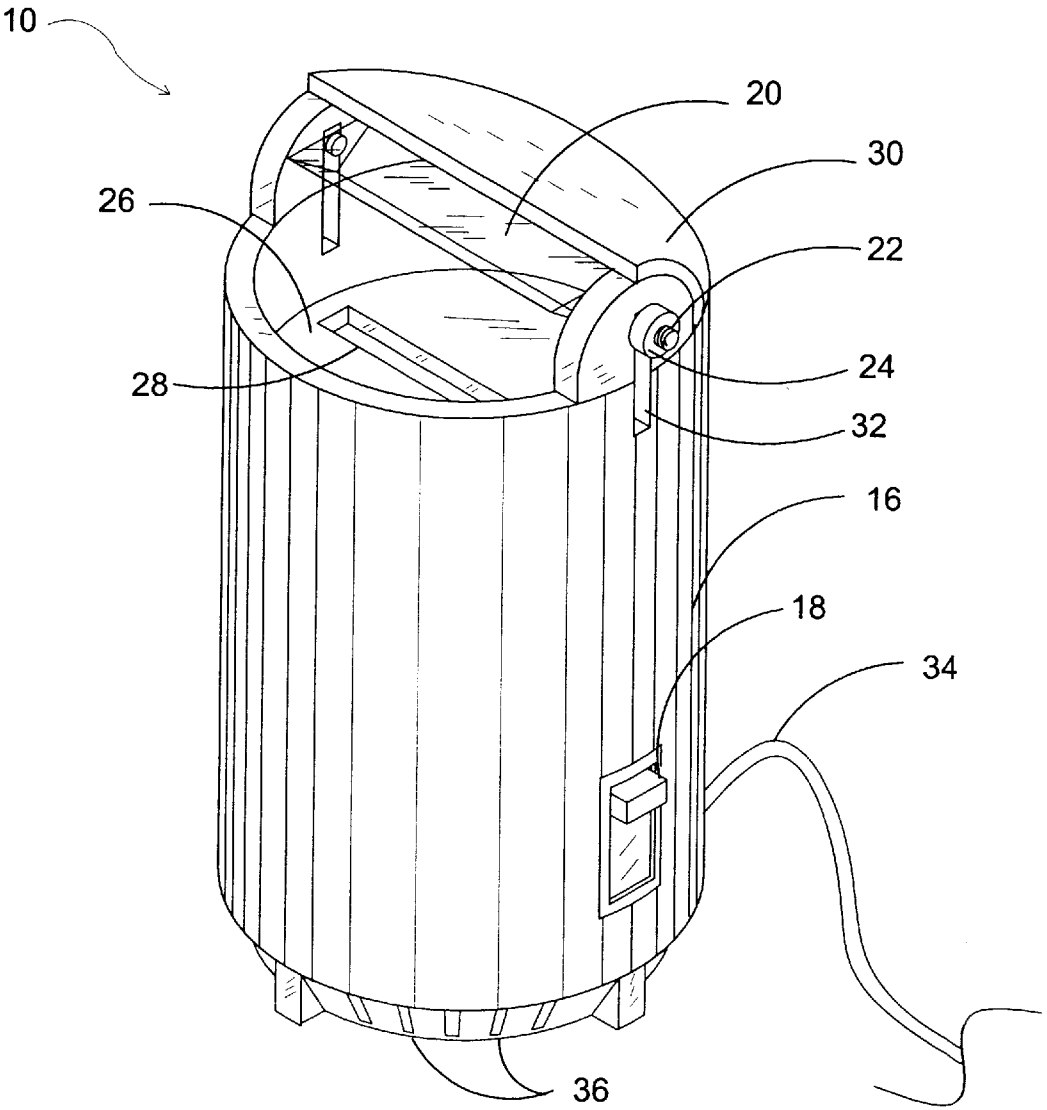
FIG. 2 is an enlarged perspective view of the present invention.

Turning to FIG. 2, shown therein is a front perspective view of the present invention 10 which operates by having an internal prism 20 produce a rainbow by separating the spectrum of white light produced by a halogen lamp. The lighting device has a cylindrical housing 16 having external means for adjusting the intensity of the display in the form of a three way dimmer switch 18. The prism 20 is selectively held in place by threaded stud members 22 with finger nuts 24 positioned at each end thereof, whereby the prism can be selectively moved or rotated from one position to another. Also shown is a planar opaque element or light filter 26 having a slot 28 therein whereby the light is projected through the prism. Also shown are a lamp cover 30, vertical slots 32 for receiving and adjustment of the threaded studs 22 along with a power source 34 and air intake vents 36 on the bottom of the housing 16.

Figure 3:
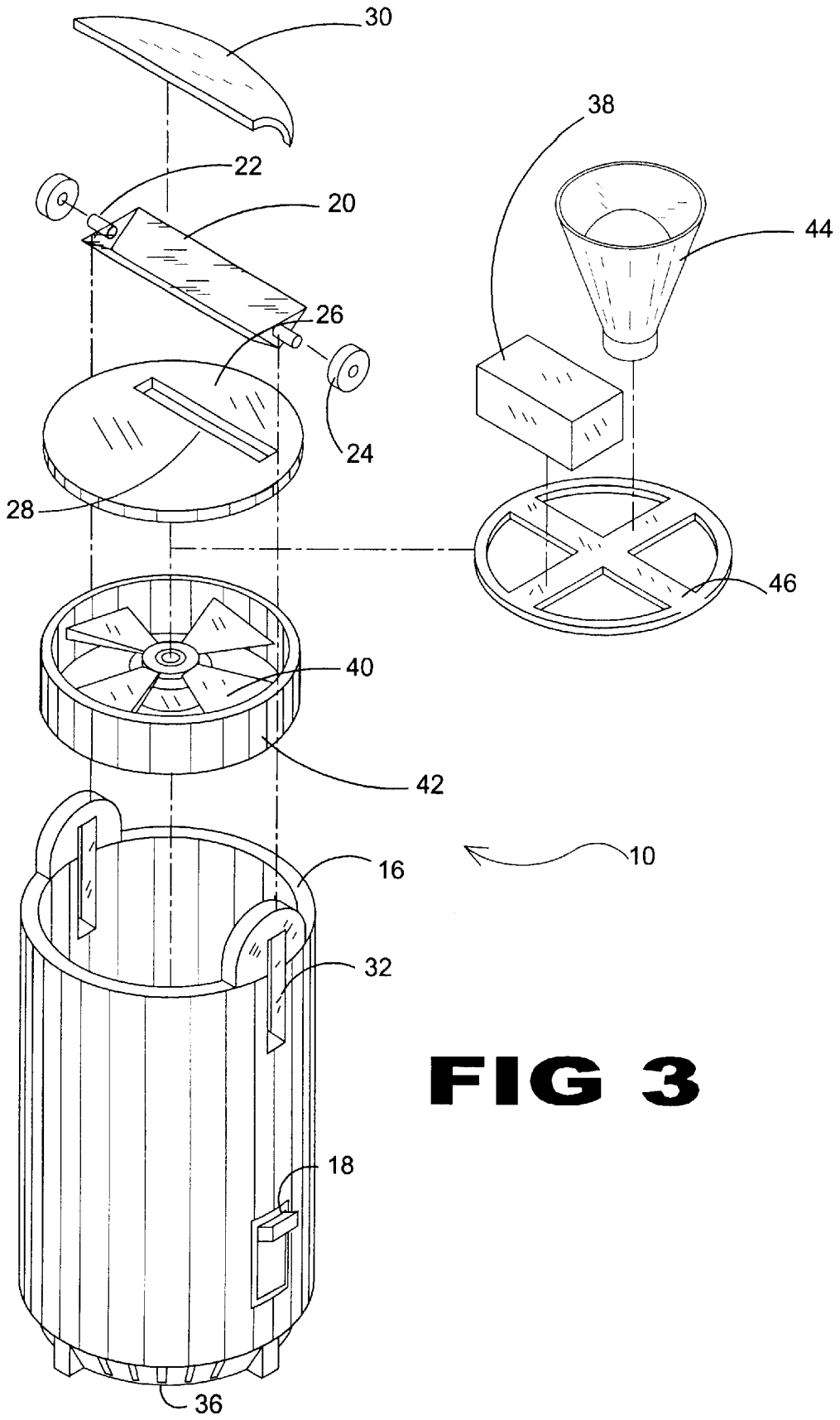
FIG. 3 is an exploded view of the present invention.

Turning to FIG. 3, shown therein is an exploded view of the present invention 10. The lighting device has a housing 16 with apertures 36 located within the base whereby the fan can prevent any accumulation of heat. There are also vertical apertures or slots disposed in the wall of the housing 16 slots 32 wherethrough extend the prism 20 holding means. The prism 20 is positioned over an opaque member 26 having a slot 28 positioned over the lighting element. The light passing through the slot 28 strikes the prism 20 and is projected into its component waveforms onto an exterior surface. Also shown is a transformer 38 for varying the intensity of the display and a prism housing cover 30. The purpose of the transformer is to reduce the voltage from 115/130 volts to 12 volts. Also shown are cooling fan 40 with housing 42, a halogen lamp 44, a support member 46 and other elements previously disclosed.

Figure 4:
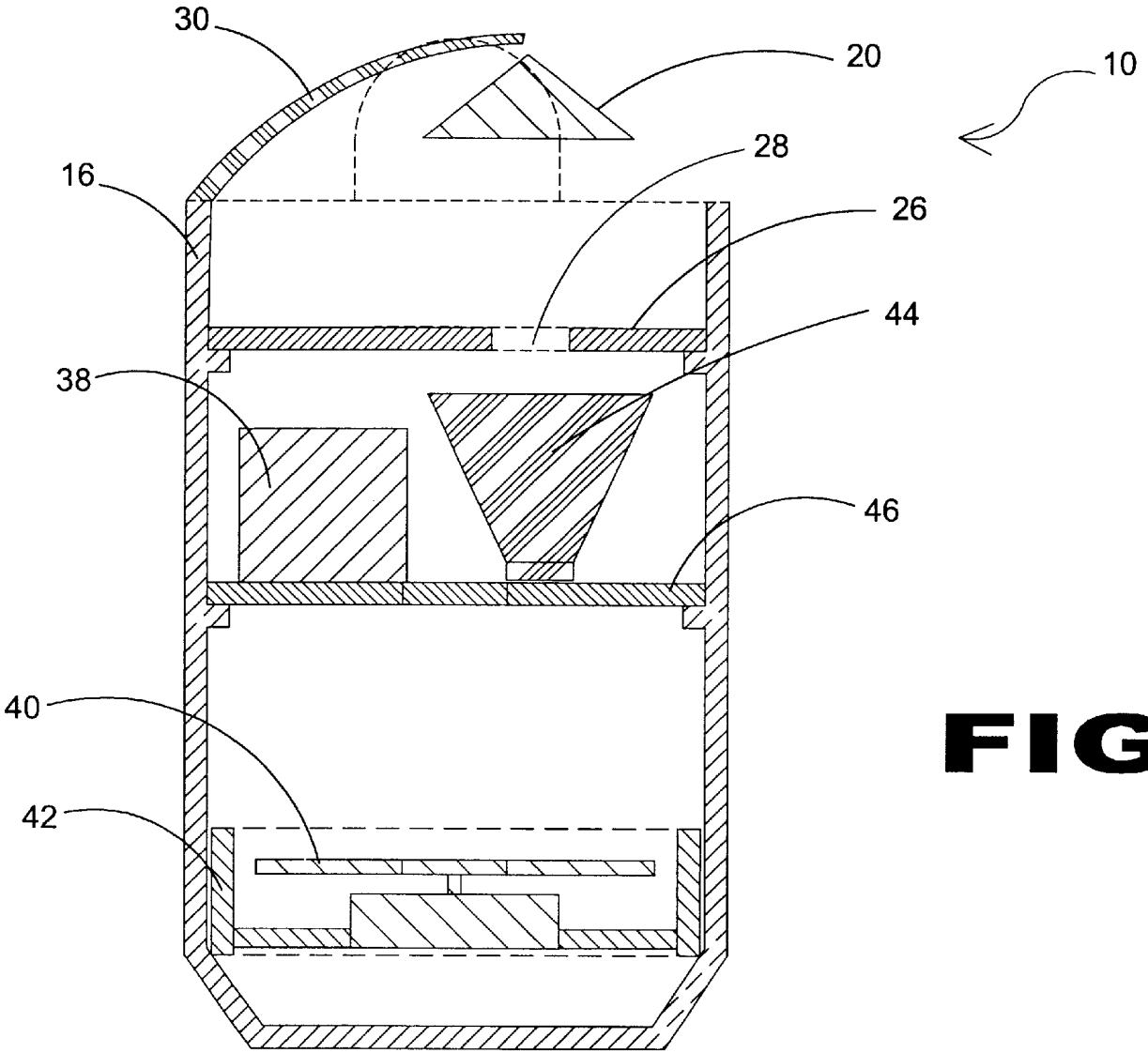
FIG. 4 is a cross sectional view of the present invention.

Turning to FIG. 4, shown therein is a cross sectional view of the present invention 10 showing the various components of the lighting fixture which have been previously disclosed.

Figure 5:
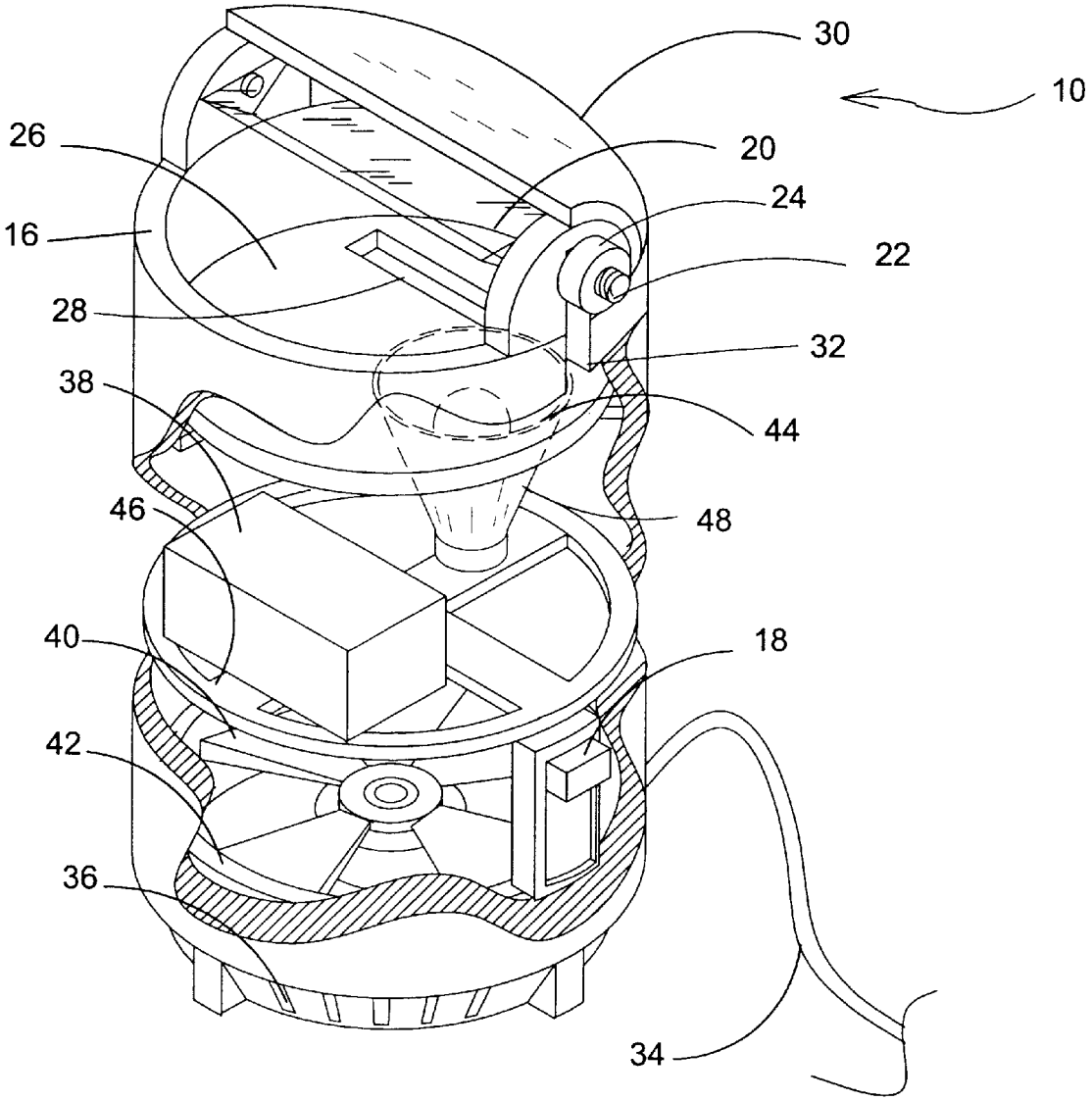
FIG. 5 is a sectional view of the present invention.

Turning to FIG. 5, shown therein is a cutaway view of the present invention 10. The fan 40 at the base of the housing 16 dissipates hot air out of the housing. The lighting fixture 48 with lamp 44 when energized emits light beams which are projected through a planar opaque element 26 having a slot 28 wherethrough the beams of light are projected onto a prism 20. The housing 16 and prism cover 30 will reduce any illumination from being transmitted by the device with the exception of the light projected through the prism 20. Other elements previously disclosed are also shown.

Figure 6:
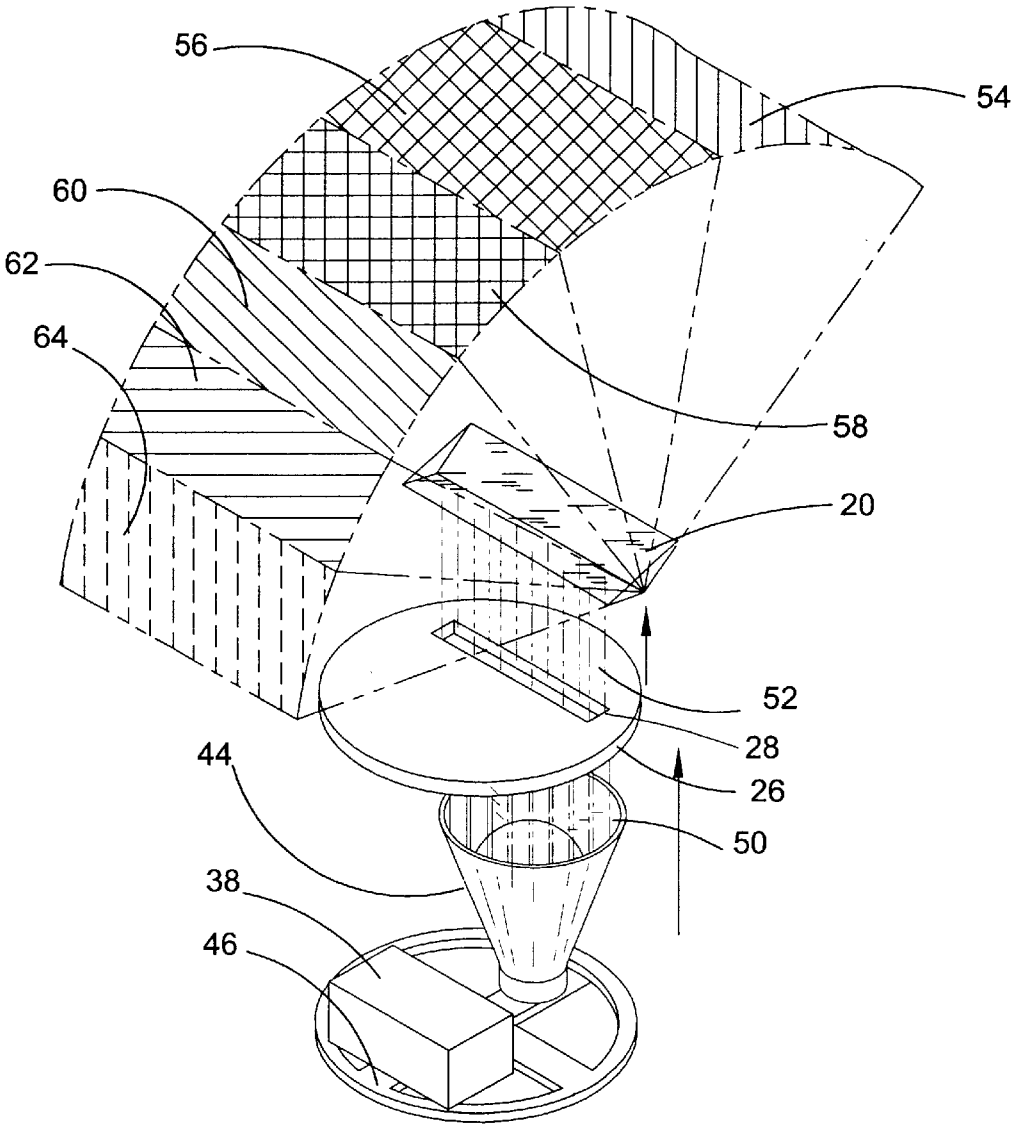
FIG. 6 is an illustrative view of the lighting components projecting a rainbow.

Turning to FIG. 6, shown therein is an illustrative view of the method used to project a rainbow. The transformer 38 support member 46 controls the intensity of the display by varying the lumens of the light bulb 44. The purpose of the transformer 38 is to reduce the voltage from 115/130 volts to 12 volts. The unfiltered light 50 passes through the slot 28 of the light filter 26 and thereafter the filtered light 52 passes through the prism 20 where the light is separated into the color spectrum of red 54, orange 56, yellow 28, green 60, blue 62 and violet 64.

Figure 7:
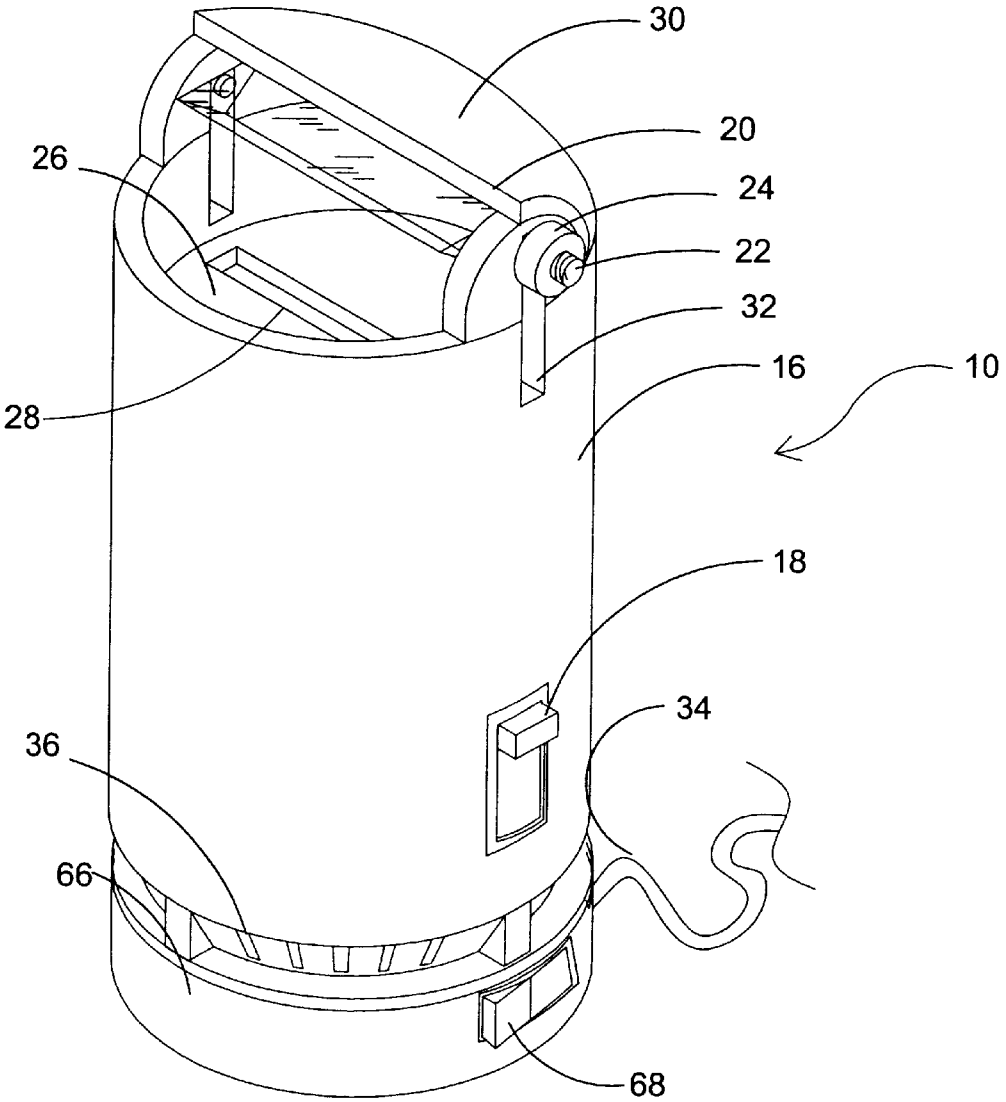
FIG. 7 is a front perspective view of the present invention.

Turning to FIG. 7, shown therein is front perspective view of the present invention 10 mounted onto a motorized base 66 having switch 68 to control the clockwise or counter-clockwise direction of rotation. The lighting device has an external switch 18 for varying the intensity of the device. Also shown are distance adjustment means being a vertical slot 32 for varying the distance between the prism 20 and light emitting aperture 28. Other elements previously disclosed are also shown.

Figure 8:
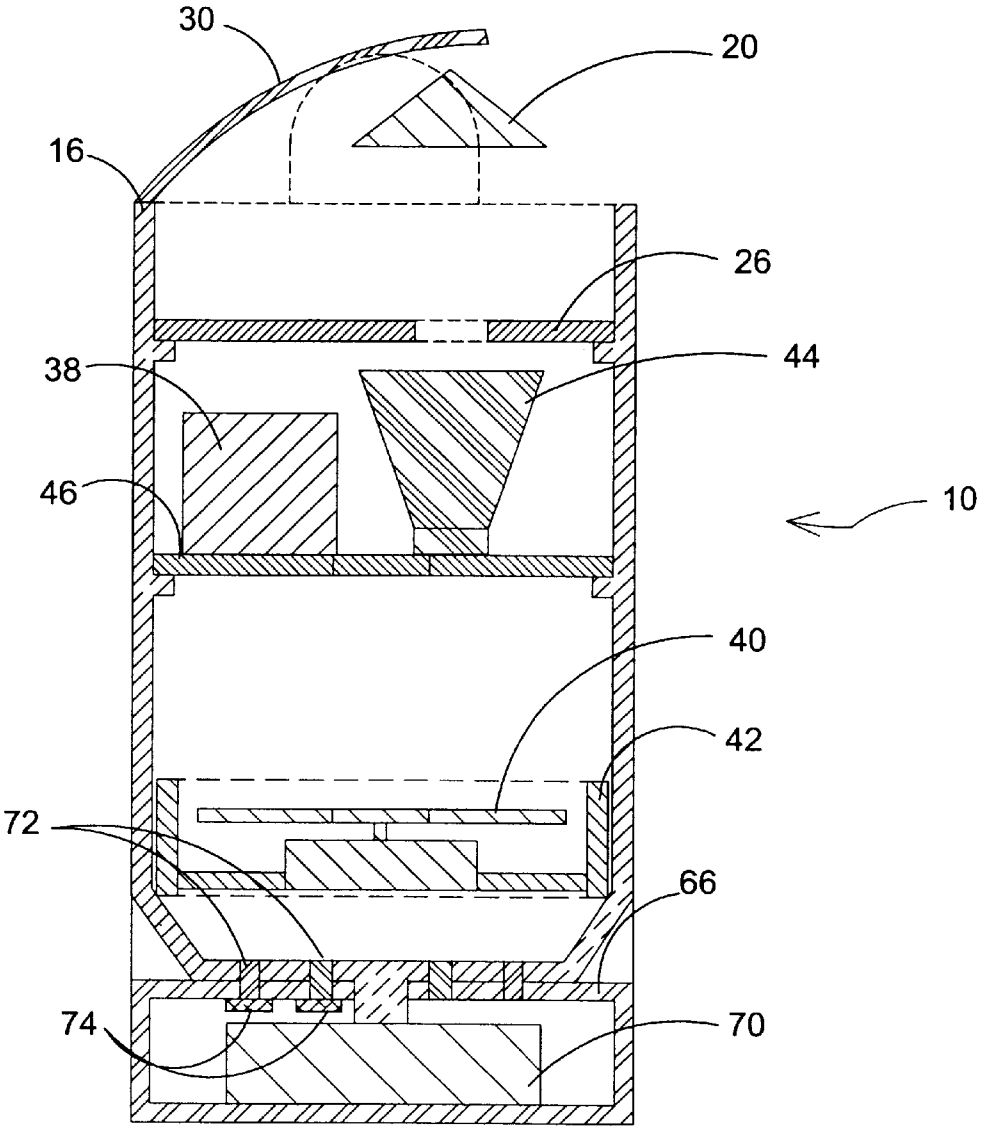
FIG. 8 is a sectional view of the present invention having a motor.

Turning to FIG. 8, shown therein is a sectional view of the present invention 10 having a motor 70 positioned at the base of the device for selectively rotating the device through 360 degrees. Also shown are copper rings 72 and contact brushes 74 which maintain an electrical connection with each other while turning. Other elements previously disclosed are also shown.

Figure 9:
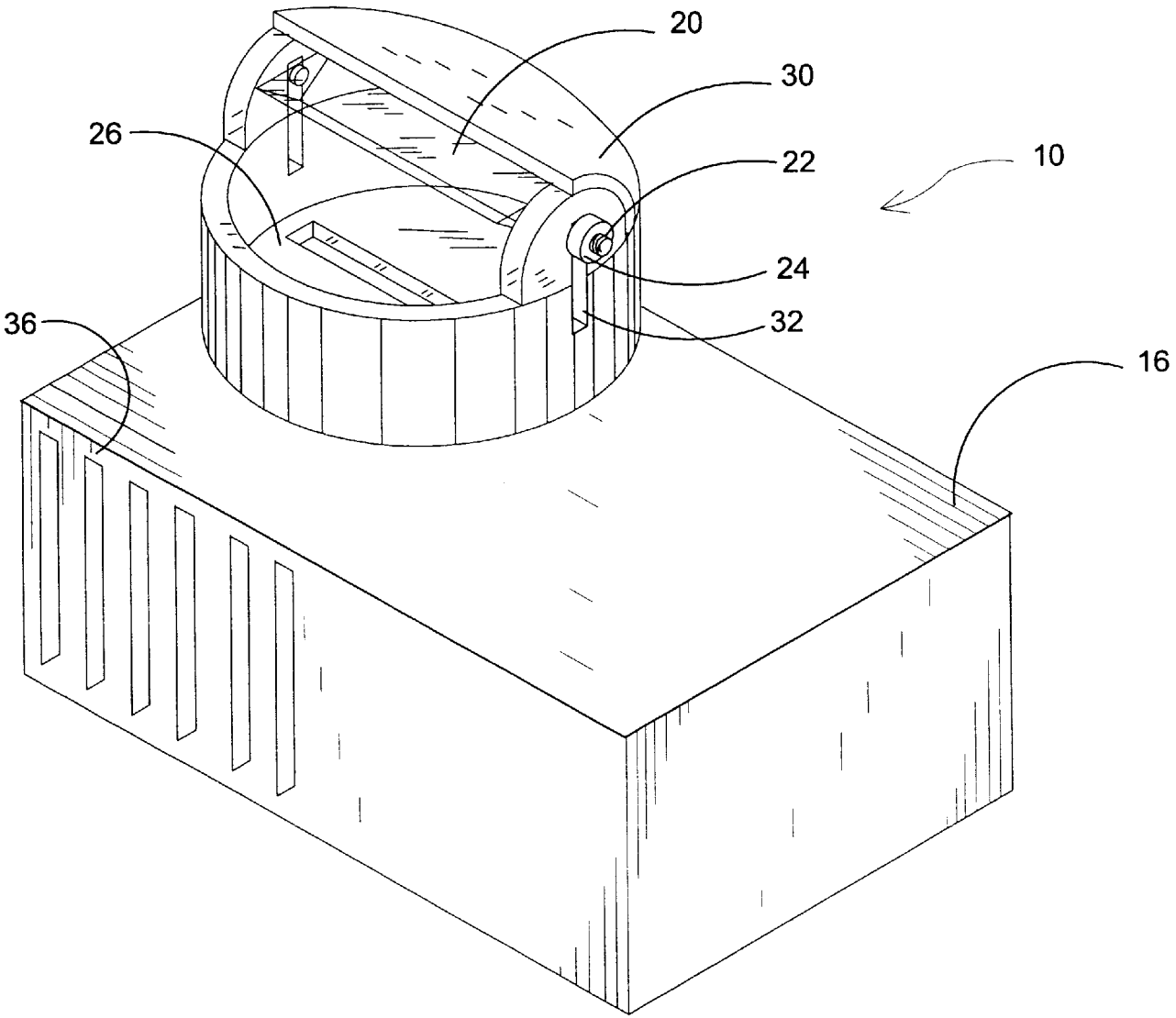
FIG. 9 is a perspective view of the present invention having a different housing.

Turning to FIG. 9, shown therein is a view of the lighting device 10 having a variation being a rectangular housing element 16 with air intake vents 36 on its sides. Other elements previously disclosed are also shown.

Figure 10:
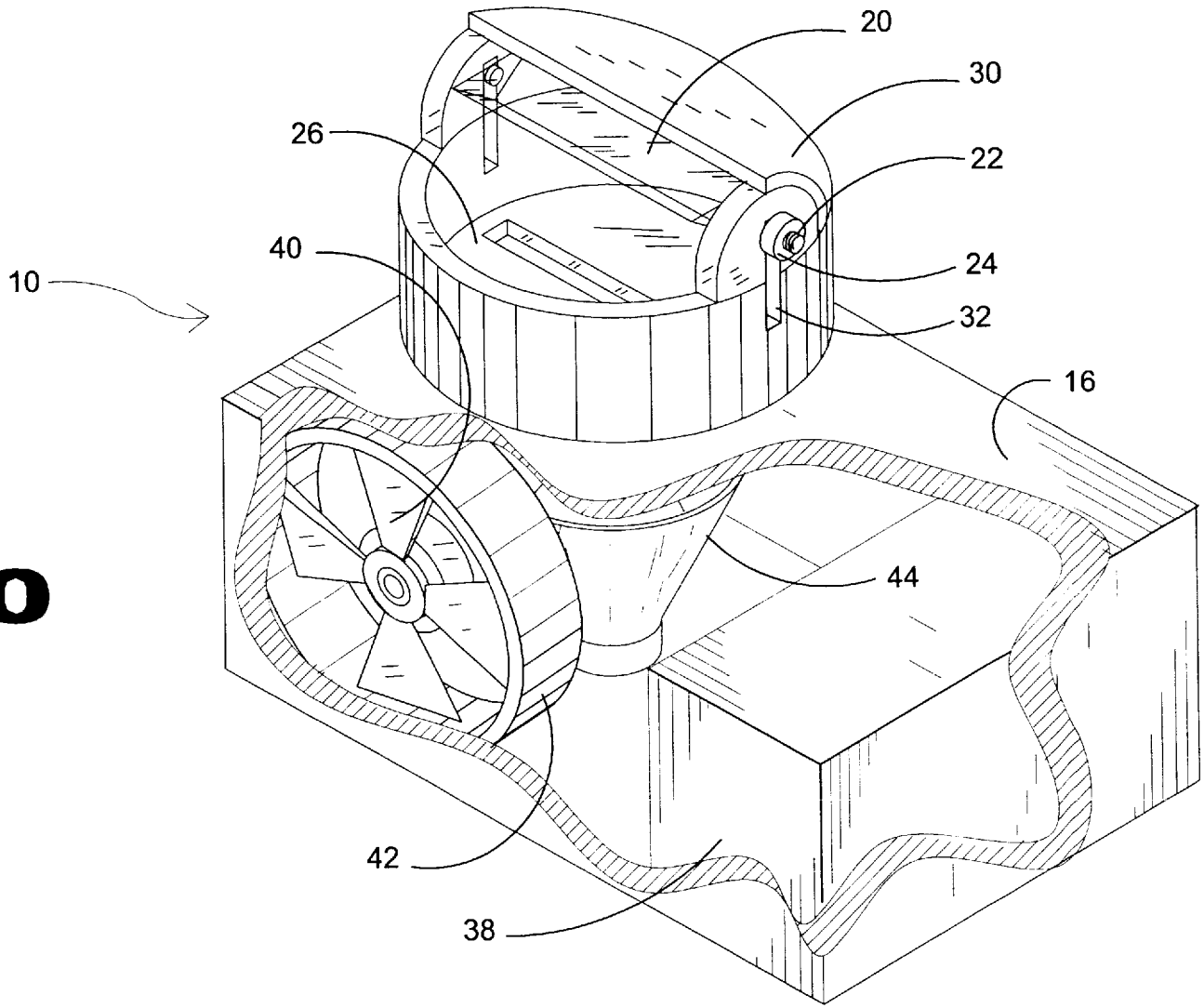
FIG. 10 is a cutaway view of the present invention as shown in FIG. 9.

Turning to FIG. 10, shown therein shows the disposition of the components of the present invention 10, as shown in FIG. 9 having all of the same components as previously disclosed for generating a rainbow onto a removed surface.

What is claimed to be new and desired to be protected by Letters Patent is set forth in the appended claims.

I claim:

1. An apparatus for projecting a spectrum of light, comprising:

a) a housing, said housing having an upper end and a lower end, wherein said housing is cylindrical, said housing have a base on said lower end;

b) means for a light source disposed internal said housing;

c) means for cooling disposed internal said housing for cooling said light source;

d) means for a light filter disposed internal said housing;

e) means for a prism disposed on said upper end of said housing through which light rays pass; and, f) a cover disposed on said upper end of said housing, wherein said base of said housing has a plurality of apertures therein, said apertures for having air pass therethrough for cooling the light source, said means for a light source further comprises a lamp, a fixture for holding said lamp, a transformer for varying the intensity of said lamp, by reducing the voltage, a control switch for said transformer, and a support member for supporting thereon said lamp, said fixture and said support member, said means for cooling further comprises a cooling fan and a fan housing and said means for a light filter further comprises an opaque disc having a light slot therein, said disc mounted above said light, said slot for receiving light rays from said light and directing said light rays onto said means for prism.

2. The apparatus of claim 1, wherein said means for a prism further comprises an elongated prism having three sides, means for adjusting said prism whereby the distance from said slot to said prism is varied and said prism is rotated.

3. The apparatus of claim 2, wherein said means for adjusting said prism further comprises a pair of threaded studs disposed on opposite ends of said prism, wherein said upper end of said housing has a pair of apertures in the wall thereof, said apertures being vertically oriented, said apertures for receiving said threaded studs, further comprising mating threaded nuts for tightening said studs to said apertures so that said studs are slidable in said apertures so that said prism is thereby adjustable.

4. The apparatus of claim 3, wherein said base is rotatable, further comprising a motor for rotating said base, a control for controlling said motor, a set of copper rings and a set of contact brushes for maintaining an electrical contact while said base rotates.

5. An apparatus for projecting a spectrum of light, comprising:

a) a housing, said housing having an upper end and a lower end, wherein said housing is rectangular, said housing having a base on said lower end;

b) means for a light source disposed internal said housing;

c) means for cooling disposed internal said housing for cooling said light source;

d) means for a light filter disposed internal said housing;

e) means for a prism disposed on said upper end of said housing through which light rays pass; and, f) a cover disposed on said upper end of said housing, wherein said housing has a plurality of apertures therein, said apertures for having air pass therethrough for cooling the light source, said means for a light source further comprises a lamp, a fixture for holding said lamp, a transformer for varying the intensity of said lamp, by reducing the voltage, and a control switch for said transformer, said means for cooling further comprises a cooling fan and a fan housing and said means for a light filter further comprises an opaque disc having a light slot therein, said disc mounted above said light, said slot for receiving light rays from said light and directing said light rays onto said means for prism.

6. The apparatus of claim 5, wherein said means for a prism further comprises an elongated prism having three sides, means for adjusting said prism whereby the distance from said slot to said prism is varied and said prism is rotated.

7. The apparatus of claim 6, wherein said means for adjusting said prism further comprises a pair of threaded studs disposed on opposite ends of said prism, wherein said upper end of said housing has a pair of apertures in the wall thereof, said apertures being vertically oriented, said apertures for receiving said threaded studs, further comprising mating threaded nuts for tightening said studs to said apertures so that said studs are slidable in said apertures so that said prism is thereby adjustable.

* * * * *